United States Patent [19]

Okada et al.

[11] Patent Number: 4,606,506

[45] Date of Patent: Aug. 19, 1986

[54] VERTICAL TYPE ROLLER MILL

[75] Inventors: Gensuke Okada, Tokyo; Tatsuo Hagiwara, Funabashi, both of Japan

[73] Assignee: Kawasaki Jukogyo Kabushiki Kaisha, Kobe, Japan

[21] Appl. No.: 607,180

[22] Filed: May 4, 1984

[51] Int. Cl.[4] ..... B02C 15/00

[52] U.S. Cl. ..... 241/109; 241/121; 241/293

[58] Field of Search ..... 241/109, 110, 117–122, 241/293

[56] References Cited

U.S. PATENT DOCUMENTS 297,083 4/1884 Morrow ..... 241/119
3,790,095 2/1974 Gillette ..... 241/117 X

FOREIGN PATENT DOCUMENTS 522298 7/1921 France ..... 241/119
22923 of 1898 United Kingdom ..... 241/117

*Primary Examiner*—Howard N. Goldberg
*Assistant Examiner*—Timothy V. Eley

[57] ABSTRACT

A vertical type roller mill for grinding a material including a grinding table and grinding rollers of a tire shape in contact with each other. The grinding table has a grinding surface composed of a surface portion constituting a portion of an imaginary conical surface having a apex located on a center axis of the table, and a curving surface portion located outwardly of and contiguous with the surface portion constituting the imaginary conical surface. The grinding rollers each have a grinding surface composed of a surface portion constituting a portion of another imaginary conical surface sharing the apex with the first mentioned conical surface, and a curving surface portion located outwardly of and contiguous with the surface portion constituting a portion of the last mentioned imaginary conical surface and having a greater curvature than the curving surface portion of the grinding surface of the grinding table. The surface portions of the grinding table and grinding rollers each constituting a portion of the respective imaginary conical surface portion define a coarse grinding zone for grinding the material into coarse particles, and the curving surface portions of the grinding table and grinding rollers define a fine grinding zone for grinding the coarse particles of the material into fine particles.

1 Claim, 3 Drawing Figures

VERTICAL TYPE ROLLER MILL

BACKGROUND OF THE INVENTION

This invention relates to improvements in or relating to vertical type roller mills, and more particularly it is concerned with a vertical type roller mill having grinding rollers of a tire shape.

In one type of vertical roller mill having grinding rollers of the tire shape of the prior art, a plurality of grinding rollers of the tire shape are arranged for rotation on a grinding table which is located horizontally and driven for rotation, and a material to be ground is fed on to the grinding table and ground between the grinding rollers and the grinding table which are rotating relative to each other.

In this type of vertical type roller mill, the grinding rollers of the tire type used for performing grinding are symmetrical in shape so that they are identical in shape on both sides. Thus, this type of rollers offer the advantage that they have a higher rate of use because they can be used by reversing their sides. However, they are not without disadvantages. The center axis of the rotary shaft of each grinding roller does not intersect the center axis of the rotary shaft of the grinding table and the material grinding surfaces of the rollers differ from the material grinding surface of the table in peripheral velocity, resulting in a production of a relative displacement (relative slipping effect) between the grinding table and the grinding rollers. Thus, when a grinding operation is performed by feeding a material to the mill, the relative displacement causes wear of a higher magnitude on the side of each grinding roller disposed near the center of the grinding table which grinds the material into coarse particles than on the opposite side remote from the center of the grinding table. The reason why the wear caused on the side remote from the center of the grinding table which crushes the coarse particles into fine particles is low in magnitude in spite of a substantial relative displacement is because the material is already ground to some degree during grinding into coarse particles when it is supplied to the remote side of each grinding roller. Owing to the difference in the magnitude of wear caused on opposite sides of each grinding roller as described hereinabove, asymmetrical wear is caused on the grinding rollers and grinding table.

If the development of the asymmetrical wear is allowed to run its course, the amount of the material ground in a unit time will be reduced and the amount of untreated material circulating in the mill will increase. As a result, the grinding efficiency of the roller mill be reduced and the consumption of electrical power required for driving the mill will rise.

SUMMARY OF THE INVENTION

This invention has been developed for the purpose of obviating the aforesaid disadvantage of the prior art. Accordingly, the invention has as its object the provision of a vertical type roller mill capable of causing uniform wear to be caused on each of the grinding rollers by keeping wear of a higher magnitude from being caused on the coarse grinding side of the roller to avoid the development of an asymmetrical wear, and capable of increasing grinding efficiency by increasing a relative displacement taking place between the fine grinding side of the roller and the grinding table.

To accomplish the aforesaid object, the invention provides the feature that a coarse grinding surface portion of the surface of the grinding table is constituted by a portion of an imaginary conical surface and a coarse grinding surface portion of each grinding roller corresponding to the coarse grinding surface portion of the grinding table is constituted by a portion of another imaginary conical surface which shares the apex with the first mentioned conical surface to keep wear of a higher magnitude from being caused on the coarse grinding side of each roller, and the feature that the grinding table is formed with a curving surface portion serving as a fine grinding surface portion disposed outwardly of and contiguous with the coarse grinding surface portion and each grinding roller is formed with a curving surface portion of a greater curvature than the curving surface portion of the grinding table to serve as a fine grinding surface portion disposed outwardly of and contiguous with the corase grinding surface portion to increase a relative displacement taking place between the fine grinding side of each grinding roller and the grinding table.

Additional and other objects, features and advantages of the invention will become apparent from the description of the preferred embodiment set forth hereinafter when considered in conjunction with the accompanying drawings.

DESCRIPTION OF THE PREFERRED EMBODIMENT

Figure 1:
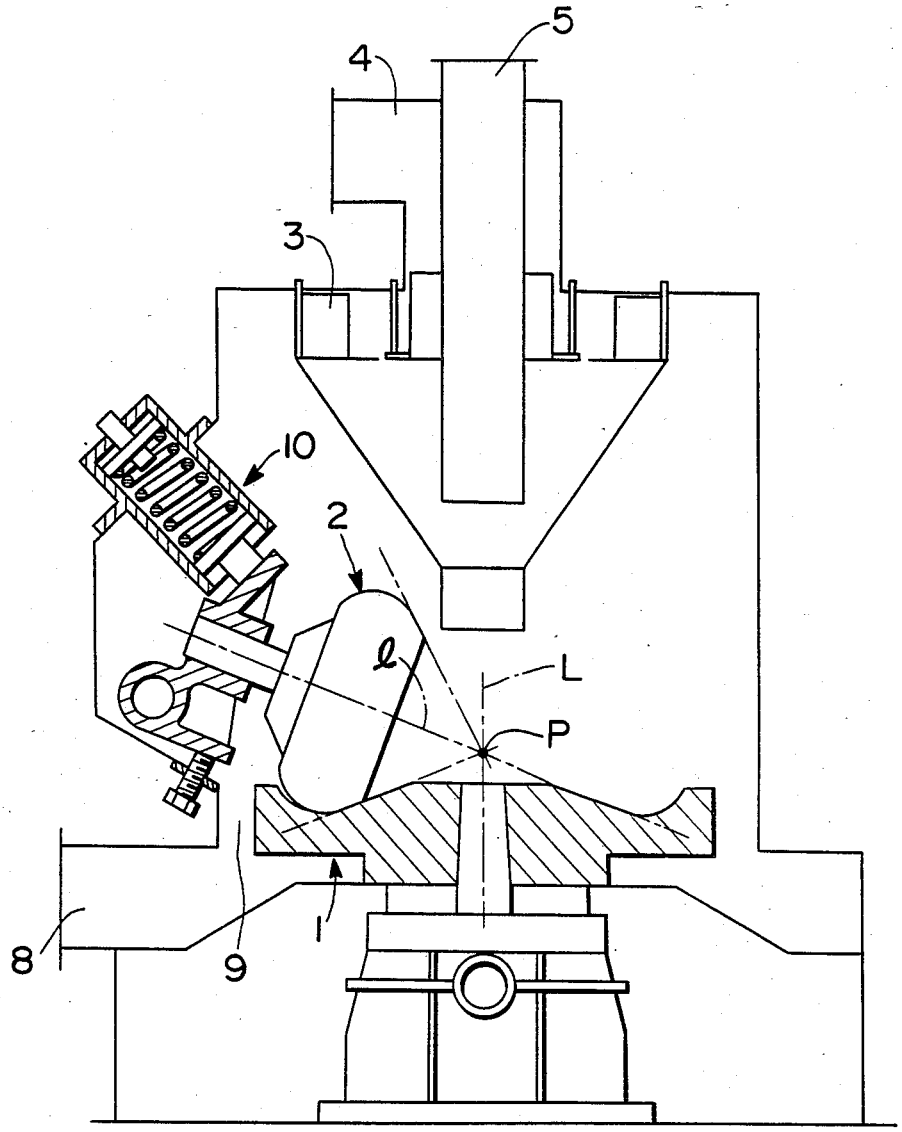
FIG. 1 is a fragmentary vertical sectional front view of the vertical type roller mill comprising one embodiment of the invention.
Figure 2:
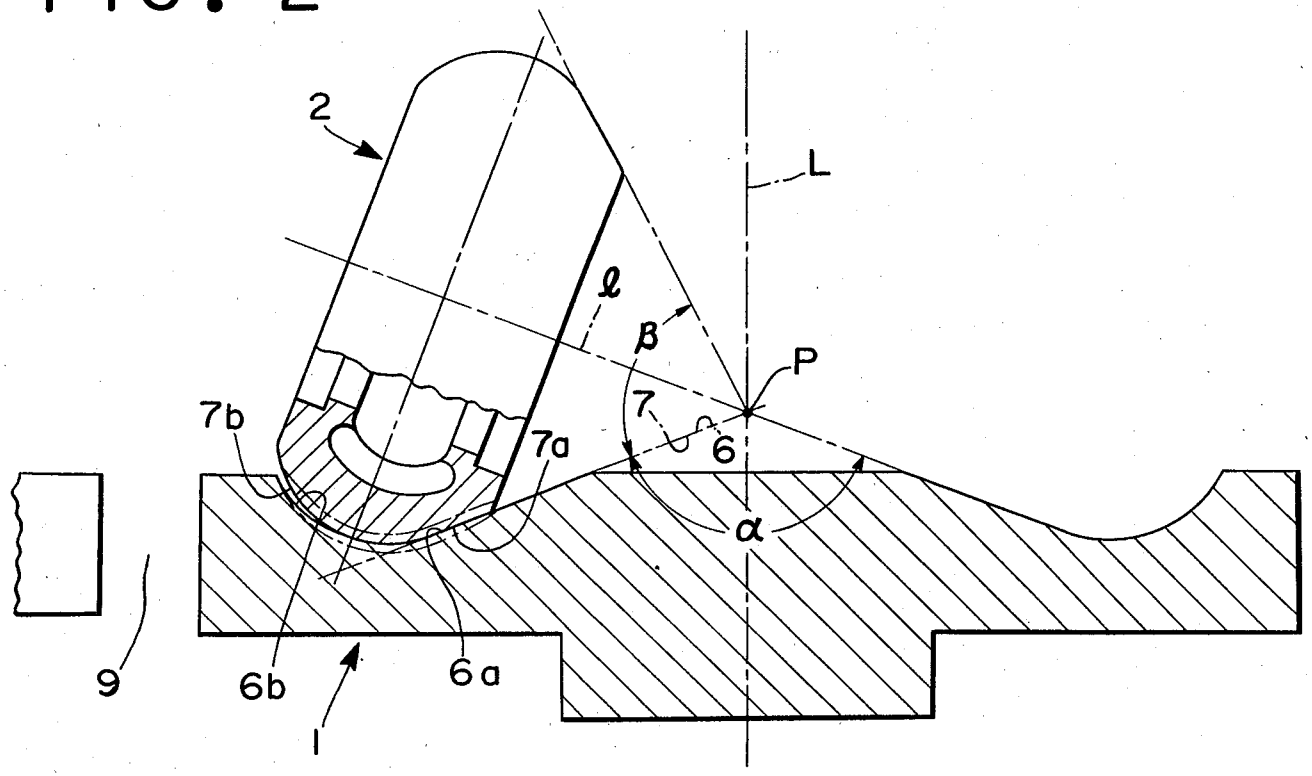
FIG. 2 is a fragmentary sectional view, on an enlarged scale, of the vertical type roller mill shown in Fig. 1, showing the condition in which wear is caused on the grinding surfaces of the grinding table and the grinding roller of the tire shape.

Referring to FIGS. 1 and 2, a grinding table 1 of the vertical type roller mill located horizontally and driven for rotation has a grinding surface including a surface portion 6*a* constituting a portion of an imaginary conical surface 6 having a vertical angle $\alpha$ and a apex located at a point P on a vertical center axis of rotation L of the grinding table 1, and a curving surface portion 6*b* disposed outwardly of and contiguous with the surface portion 6*a*. The vertical type roller mill comprises a plurality of grinding rollers (which are three in number in this embodiment) 2 located for rotation on the grinding surface of the grinding table 1 and each having a center axis of rotation l extending through the point P of the imaginary conical surface 6 including the surface portion 6*a* of the grinding table 1. Thus, each grinding roller 2 has a grinding surface including a surface portion 7*a* constituting a portion of another imaginary conical surface 7 having a vertical angle $\beta$ and a apex located at the point P which constitutes the apex of the imaginary conical surface 6, and a curving surface portion 7*b* of a greater curvature than the curving surface portion 6*b* of the grinding table 1 located outwardly of and contiguous with the surface portion 6*a*. The grinding rollers 2 are each forced by pressing means 10 against the grinding surface of the grinding table 1.

In the vertical type roller mill according to the invention, the grinding surfaces of the grinding table 1 and each grinding roller 2 include the surface portions *6a* and *7a* each constituting a portion of an imaginary conical surface (hereinafter first surface portions) and the curving surface portions *6b* and *7b* (hereinafter second surface portions) respectively. The reason why the grinding table 1 and grinding rollers 2 are provided with the first and second surface portions of the aforesaid construction will be described in detail hereinafter.

Assume that each grinding roller 2 having its center axis of rotation l extending through the point P of the imaginary conical surface 6 has a grinding surface at its outer periphery which is in contact with the grinding surface of the grinding table 1. Then, it would be possible to eliminate the relative displacement or relative slipping effect which might otherwise take place between the grinding surfaces of the table 1 and roller 2. However, if the grinding surface of the roller 2 were disposed in its entirety on the imaginary conical surface 6, the discharge of the grinding material would be accelerated and the amount of the material discharged from the mill without being ground would increase thereby reducing the grinding efficiency of the mill.

Figure 3:
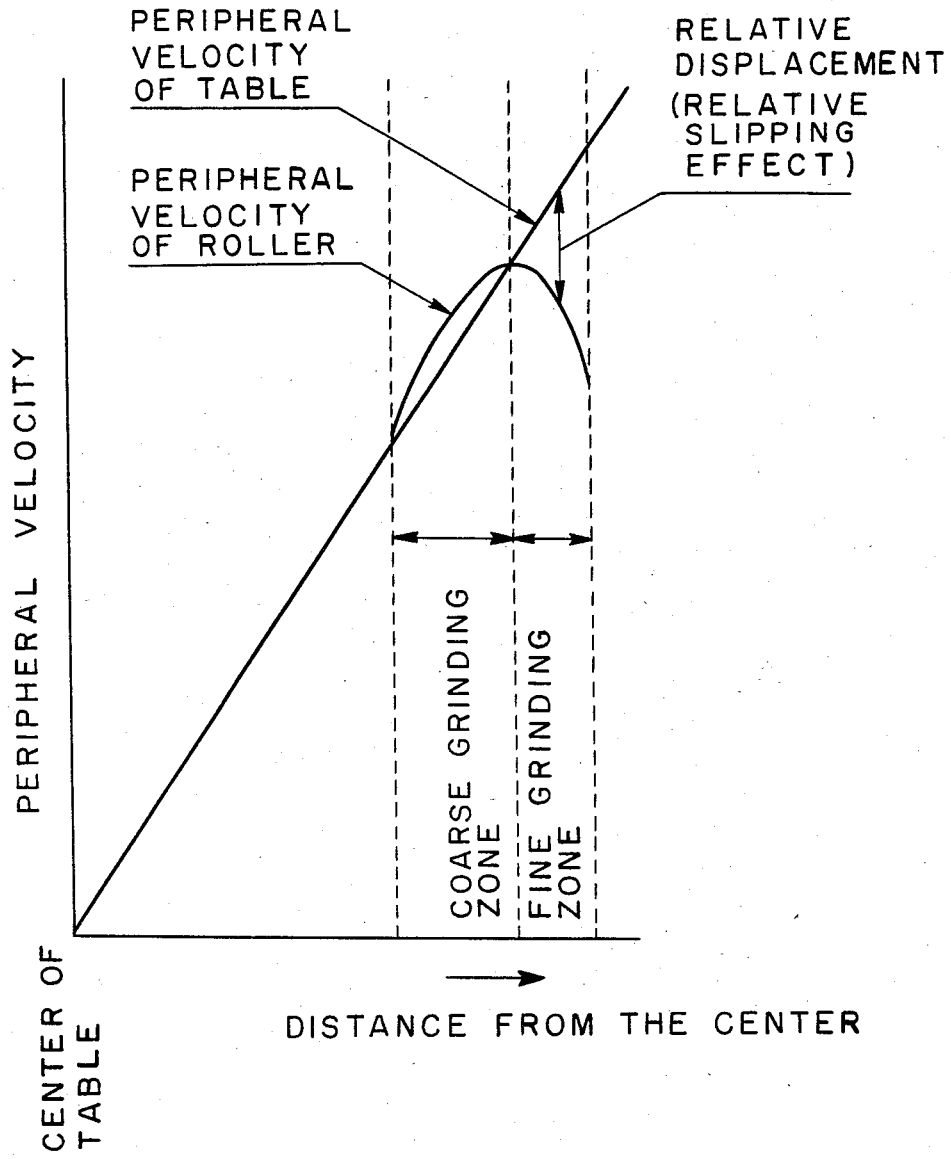
FIG. 3 is a graph showing the relative displacement or relative slipping effect between the roller and the table.

The grinding table 1 and grinding rollers 2 having grinding surfaces of the aforesaid construction operate as follows. A material to be ground is fed through a material supply hopper 5 on to the grinding table 1. The material thus fed is ground between the grinding table 1 and the grinding rollers 2 as they rotate. As described hereinabove, the center axis of rotation l extends through the point P of the imaginary conical surface 6 of which the first surface portion *6a* of the grinding surface of the grinding table 1 constitutes a portion. This brings the first surface portion *6a* of the table 1 into rolling contact with the first surface portion *7a* of each roller 2 to grind the material therebetween. At this time, a peripheral velocity of table 1 is nearly equivalent to a peripheral velocity of rollers 2 in the first surface portions *6a* and *7a* defining a coarse grinding zone as shown in FIG. 3, so that a relative displacement is prevented occurring in said zone. Accordingly, wear caused on the table 1 and rollers 2 in the coarse grinding zone is greatly reduced.

The material thus subjected to coarse grinding shifts to a fine grinding zone in which the second surface portions *6b* and *7b* of the table 1 and rollers 2 are in rolling contact with each other, so that the coarse particles of material are further ground into fine particles between them. As described hereinabove, the second surface portion *7b* of the rollers 2 is greater in curvature than the second surface portion *6b* of the table 1. Thus, a peripheral velocity of table 1 is much greater than that of rollers 2, so that a relative displacement of a high magnitude takes place between the two second surface portions *6b* and *7b* as shown in FIG. 3, thereby increasing grinding efficiency when the coarse particles of material are ground into fine particles. An increase in grinding efficiency allows wear to be uniformly caused on the second surface portions *6b* and *7b*, thereby greatly reducing the wear caused on the second surface portions *6b* and *7b* per unit area.

As described hereinabove, the wear caused on the first and second surface portions *6a*, *7a* and *6b*, *7b* defining the fine grinding zone and coarse grinding zone, respectively, is greatly reduced and occurs symmetrically. Because of this, no reduction in the amount of material ground by the mill occurs and no unground material mingles in the finely ground fine particles with only a small amount of coarse particles mixing in the fine particles. The fine particles released from the fine crushing zone are discharged from the grinding table 1 to an outer periphery of the grinding table 1 and blown by high speed air currents fed through an air inlet port 8 and distributed through slits 9 at the outer periphery of the grinding table 1 to fly to an upper portion of the mill where the coarse particles mingling in the fine particles are separated by guide vane 3 and move downwardly on to the grinding table 1 again while the fine particles are released through a fine particle outlet port 4 to outside. The corase particles moving downwardly on to the grinding table 1 are mixed with the material fed through the material supply hopper 5 on to the grinding table 1. However, the coarse particles returned to the grinding table 1 are small in amount. Thus, the amount of material circulating in the mill is reduced and grinding efficiency increases, thereby greatly reducing the consumption of energy for driving the mill. As described hereinabove, the surface of the grinding table 1 and the surface of each grinding roller 2 are worn uniformly, so that the material is subjected to grinding in an orderly and stable manner or first roughly ground and then pulverized. With the mill operating in this fashion, it makes almost no noise and its vibration is minimized while the grinding table 1 and grinding rollers 2 have a high rate of use.

From the foregoing description, it will be appreciated that in the vertical type roller mill according to the invention, a relative displacement taking place between the grinding table and grinding rollers is reduced and the wear caused on them is greatly reduced in the coarse grinding zone while the relative displacement increases and grinding efficiency improves in the fine grinding zone. As a result, the grinding surfaces of all the grinding rollers and the grinding surface of the grinding table are uniformly worn. Thus, no reduction occurs in the amount of material ground in the mill due to the progress of wear caused on the grinding surfaces, and the consumption of energy for driving the mill is reduced due to an improvement in grinding efficiency. Since no asymmertical wear is caused on the grinding surfaces of the grinding table and grinding rollers, their service lives are prolonged, and the noise and vibration occurring during operation of the mill can be minimized.

What is claimed is:

1. A vertical type roller mill comprising:

a grinding table located horizontally and driven for rotation about a vertical center axis;

a plurality of grinding rollers supported on said grinding table for rotation each about its own axis while being maintained in contact with the grinding table, and means for feeding material to be ground into said mill;

said grinding table having a grinding surface composed of a first table surface portion and a second table surface portion located outwardly of and contiguously with the first table portion, said first table surface portion constituting a portion of a conical surface having an apex on the vertical center axis of the grinding table and said second table surface portion comprising a curved table surface portion;

said grinding rollers each having a grinding surface composed of a first roller surface portion and a second roller surface portion located outwardly of and contiguous with the first roller surface portion, said first roller surface portion constituting a frusto-conical surface having a longitudinal centerline intersecting the apex of the table conical surface, and said second roller surface portion comprising a curved surface portion of a greater curvature than the curving surface portion of the grinding surface of said grinding table, said first surface portions being located upstream of said second surface portions with respect to the feeding direction of the material; said first table surface portion and said first roller surface portion of each grinding roller defining a coarse grinding zone for grinding a material into coarse particles, and said second table surface portion and said second roller surface portion of each grinding roller defining a fine grinding zone for grinding the coarse particles into fine particles.

* * * * *